US012311501B2

(12) United States Patent
Hsu

(10) Patent No.: US 12,311,501 B2
(45) Date of Patent: May 27, 2025

(54) SYSTEM AND METHOD FOR REMOVING DEBRIS DURING CHEMICAL MECHANICAL PLANARIZATION

(71) Applicant: Taiwan Semiconductor Manufacturing Co., Ltd., Hsinchu (TW)

(72) Inventor: Chun-Wei Hsu, Hsinchu (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 0 days.

(21) Appl. No.: 18/447,211

(22) Filed: Aug. 9, 2023

(65) Prior Publication Data

US 2023/0381923 A1 Nov. 30, 2023

Related U.S. Application Data

(62) Division of application No. 17/192,813, filed on Mar. 4, 2021, now Pat. No. 12,017,325.

(51) Int. Cl.
*B24B 57/02* (2006.01)
*B24B 37/04* (2012.01)

(52) U.S. Cl.
CPC ..... *B24B 57/02* (2013.01); *B24B 37/042* (2013.01)

(58) Field of Classification Search
CPC ..... B24B 7/228; B24B 37/042; B24B 37/044; B24B 37/30; B24B 37/32; B24B 37/245; B24B 53/017; B24B 53/095; B24B 55/02; B24B 55/03; B24B 55/12; B24B 57/02
USPC ..... 451/36, 41, 56, 60, 286, 287, 388, 443, 451/444, 446, 453, 456
See application file for complete search history.

(56) References Cited

U.S. PATENT DOCUMENTS

| | | | | |
|---|---|---|---|---|
| 6,190,236 | B1 | 2/2001 | Drill | |
| 6,241,587 | B1 | 6/2001 | Drill et al. | |
| 6,530,827 | B2 | 3/2003 | Mitsuhashi | |
| 6,572,453 | B1 * | 6/2003 | Wijekoon | B24B 37/04 257/E21.304 |
| 6,626,743 | B1 | 9/2003 | Boyd | |
| 7,040,967 | B2 * | 5/2006 | Benner | B24B 57/02 438/692 |
| 7,258,600 | B1 | 8/2007 | Benner | |
| 7,544,113 | B1 * | 6/2009 | Benner | B24B 53/00 451/21 |

(Continued)

FOREIGN PATENT DOCUMENTS

| | | | | |
|---|---|---|---|---|
| JP | H09290363 A | * | 11/1997 | B24B 37/00 |
| JP | 3011168 B2 | | 2/2000 | |
| TW | 467799 B | | 12/2001 | |

OTHER PUBLICATIONS

Machine translation of JP-H09290363-A (Year: 1997).*

*Primary Examiner* — Robert F Neibaur
(74) *Attorney, Agent, or Firm* — Seed IP Law Group

(57) ABSTRACT

A chemical mechanical planarization system includes a chemical mechanical planarization pad that rotates during a chemical mechanical planarization process. A chemical mechanical planarization head places a semiconductor wafer in contact with the chemical mechanical planarization pad during the process. A slurry supply system supplies a slurry onto the pad during the process. A pad conditioner conditions the pad during the process. A suction system removes pad conditioner debris and the slurry from the pad.

19 Claims, 6 Drawing Sheets

(56) References Cited

U.S. PATENT DOCUMENTS

| | | | | |
|---|---|---|---|---|
| 8,297,830 | B2 * | 10/2012 | Tseng | B24B 37/04 366/159.1 |
| 9,375,825 | B2 * | 6/2016 | Sun | B24B 55/06 |
| 10,636,665 | B2 * | 4/2020 | Shinozaki | B24B 37/10 |
| 10,843,307 | B2 * | 11/2020 | Wei | H01L 21/67219 |
| 2003/0095894 | A1 | 5/2003 | Umezawa et al. | |
| 2007/0087672 | A1 | 4/2007 | Benner | |
| 2011/0048542 | A1 * | 3/2011 | Weinstock | B24B 57/00 137/551 |
| 2011/0070811 | A1 * | 3/2011 | Neuber | B24B 57/00 451/60 |
| 2014/0323017 | A1 | 10/2014 | Tang et al. | |
| 2015/0024661 | A1 * | 1/2015 | Peng | B08B 3/02 451/72 |
| 2019/0358771 | A1 | 11/2019 | Huang | |
| 2022/0267644 | A1 | 8/2022 | Furuta et al. | |

* cited by examiner

SYSTEM AND METHOD FOR REMOVING DEBRIS DURING CHEMICAL MECHANICAL PLANARIZATION

BACKGROUND

Technical Field

The present disclosure relates to the field of chemical mechanical planarization.

Description of the Related Art

There has been a continuous demand for increasing computing power in electronic devices including smart phones, tablets, desktop computers, laptop computers and many other kinds of electronic devices. Integrated circuits provide the computing power for these electronic devices. One way to increase computing power in integrated circuits is to increase the number of transistors and other integrated circuit features that can be included for a given area of semiconductor substrate. Accordingly, many semiconductor processes and techniques have been developed to decrease the size of features in integrated circuits.

Chemical mechanical planarization is a process that has enabled the use of thin film materials that enable features of relatively small size. Chemical mechanical planarization can planarize the surface of a semiconductor wafer after thin film deposition and patterning processes. Chemical mechanical planarization utilizes chemical and mechanical processes to planarize the semiconductor wafer. While highly beneficial, chemical mechanical planarization can also be susceptible to equipment failure resulting in damaged semiconductor wafers.

DETAILED DESCRIPTION

Figure 1:
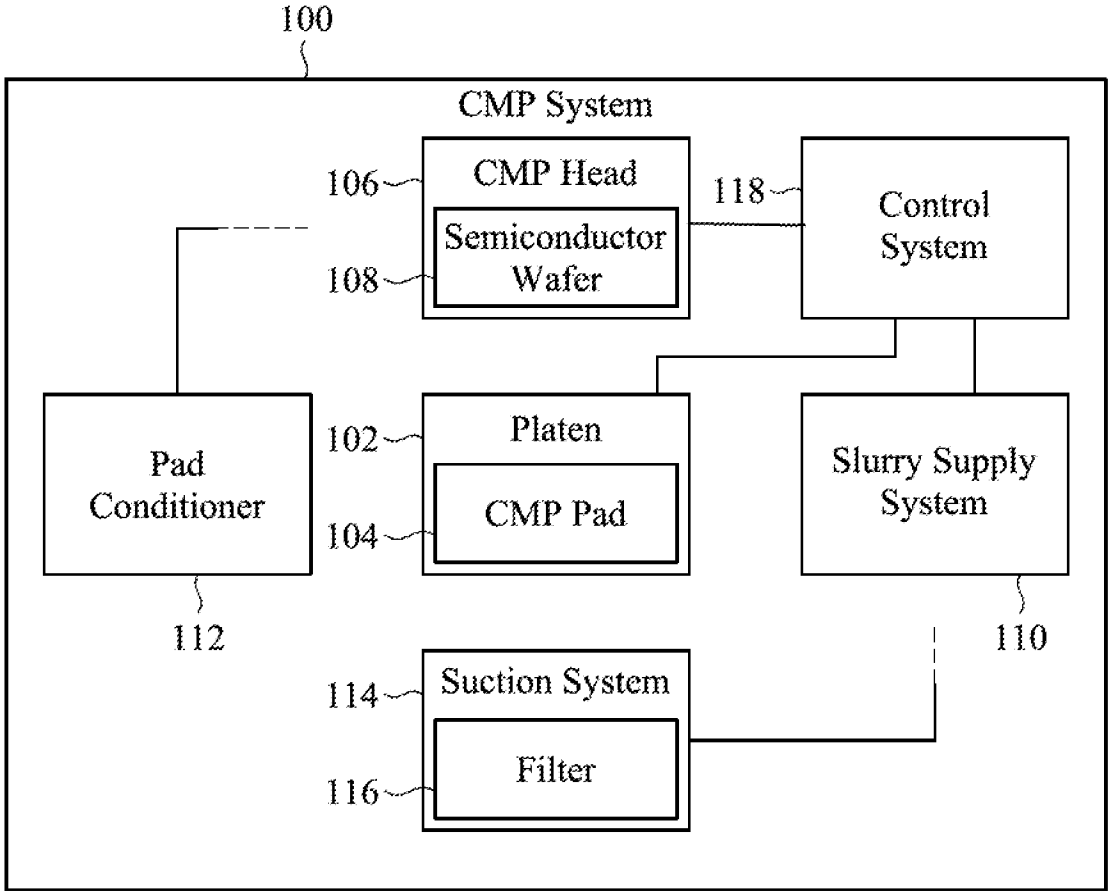
FIG. 1 is a block diagram of a chemical mechanical planarization system, according to one embodiment.

In the following description, many thicknesses and materials are described for various layers and structures within an integrated circuit die. Specific dimensions and materials are given by way of example for various embodiments. Those of skill in the art will recognize, in light of the present disclosure, that other dimensions and materials can be used in many cases without departing from the scope of the present disclosure.

The following disclosure provides many different embodiments, or examples, for implementing different features of the described subject matter. Specific examples of components and arrangements are described below to simplify the present description. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In the following description, certain specific details are set forth in order to provide a thorough understanding of various embodiments of the disclosure. However, one skilled in the art will understand that the disclosure may be practiced without these specific details. In other instances, well-known structures associated with electronic components and fabrication techniques have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

The use of ordinals such as first, second and third does not necessarily imply a ranked sense of order, but rather may only distinguish between multiple instances of an act or structure.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments of the present disclosure provide many benefits over traditional chemical mechanical planarization systems. Embodiments of the present disclosure utilize a suction system to prevent damage to semiconductor wafers and chemical mechanical planarization equipment. Accordingly, embodiments of the present disclosure increase semiconductor wafer yields and reduce the need for technicians or experts repair or replace damaged equipment. Instead, the suction system removes dangerous debris from the chemical mechanical planarization pad before the debris can damage the pad or the semiconductor wafer. The result is that time and resources are not wasted replacing equipment and scrapped semiconductor wafers.

FIG. 1 is a block diagram of a chemical mechanical planarization (CMP) system 100, according to one embodiment. The CMP system 100 includes a platen 102, a CMP head 106, a slurry supply system 110, a pad conditioner 112, and the suction system 114. The components of the CMP system 100 cooperate to provide an efficient CMP process that reduces the potential for damage to CMP equipment or semiconductor wafer. In particular, as will be set forth in more detail below, the suction system 114 helps to prevent damage to CMP equipment and semiconductor wafers.

In one embodiment, the platen 102 is a flat circular surface. The platen 102 is configured to rotate during CMP processes. The platen 102 may rotate with a rotational velocity of between 20 RPM and 40 RPM, though other rotational velocities can be utilized without departing from the scope of the present disclosure. The platen 102 can be coupled to a shaft that drives the rotation of the CMP platen 102. The platen 102 may have a diameter of about 50 cm to 75 cm, though platens of other sizes can be utilized without departing from the scope of the present disclosure.

The CMP system 100 includes a CMP pad 104. The CMP pad 104 is positioned on top of the platen 102. The CMP pad 104 may be circular and may have a diameter that is substantially identical to the diameter of the platen 102. The CMP pad 104 may be coupled to the platen 102 by fasteners, by suction (i.e., pressure differential), by electrostatic force, or in any suitable way. When the platen 102 rotates, the CMP pad 104 also rotates. The rotation of the CMP pad 104 is one of the factors that planarizes the semiconductor wafer 108, as will be described in more detail below.

The CMP pad 104 can be made of a porous material. In one example, the CMP pad 104 is made from a polymeric material having a pore size between 20 micrometers and 50 micrometers. The CMP pad 104 may have a roughness of about 50 μm. Other materials, dimensions, and structures of a CMP pad 104 can be utilized without departing from the scope of the present disclosure. The CMP pad 104 may be substantially rigid.

The slurry supply system 110 supplies a slurry onto the rotating pad 104 during the CMP process. The slurry can include a solution of water and one or more corrosive compounds. The corrosive compounds are selected to chemically etch or remove one or more materials on the surface of the semiconductor wafer 108. Accordingly, the compounds in the slurry are selected based on the material or materials of the surface features of the semiconductor wafer 108 to be planarized. The slurry supply system 110 can include a tank that holds the slurry and a tube or hose that delivers the slurry onto the rotating CMP pad 104 during the CMP process.

The pad conditioner 112 conditions the rotating CMP pad 104 during the CMP process. During the CMP process, the top surface of the rotating CMP pad 104 experiences wear from the planarization process. The top surface of the rotating pad 104 may wear out unevenly such that depressions, valleys, and peaks may form in the CMP pad 104. The pad conditioner 112 includes a rotating pad conditioner head that is pressed downward onto the rotating CMP pad 104. The rotating pad conditioner head includes or is coated with a hard, durable material that can effectively sand down the surface of the CMP pad 104. In one example, the surface of the pad conditioner 112 includes a diamond material. The rotating head of the pad conditioner 112 sweeps across the surface of the rotating CMP pad 104 in a pattern selected to maintain a substantially even top surface of the CMP pad 104 during the CMP process. Accordingly, the pad conditioner 112 removes or prevents the formation of depressions, ridges, valleys, or uneven features on the surface of the rotating CMP pad 104.

During the CMP process, the CMP head 106 places the downward facing surface of the semiconductor wafer 108 into contact with the rotating CMP pad 104. The CMP head 106 may also rotate the semiconductor wafer 108 during the CMP process. Surface features of the downward facing surface of the semiconductor wafer 108 are planarized during the CMP process. The planarization is achieved by both mechanical and chemical processes. The mechanical aspect of the planarization is achieved by the physical effect of the CMP pad 104 rubbing down the bottom facing surface of the semiconductor wafer 108. The mechanical aspect of the planarization is akin to a very fine sanding process. The chemical aspect of the planarization is achieved by the chemical effect of the slurry on the materials of the surface features of the semiconductor wafer 108. The compounds in the solution of the slurry etch or otherwise react with and remove the materials of the surface features of the semiconductor wafer 108. The result of the CMP process is that the exposed bottom facing surface of the semiconductor wafer 108 becomes substantially planar.

While the CMP process may be generally effective, several problems may arise that can damage the equipment of the CMP system 100 and the semiconductor wafer 108. For example, it is possible that some of the surface material of the pad conditioner 112 may break off or otherwise become dislodged from the pad conditioner 112. This results in pad conditioner debris on the rotating CMP pad 104. The debris can include grains, particles, shards, or fragments of the material from the pad conditioner 112. In one example, the debris includes diamond material. The rotating CMP pad 104 may carry the pad conditioner debris into contact with the semiconductor wafer 108. The contact of the pad conditioner debris with the semiconductor wafer 108 can scratch, fracture, or otherwise damage the semiconductor wafer 108. If the semiconductor wafer 108 is damaged by the pad conditioner debris, then the semiconductor wafer 108 may need to be scrapped. Additionally, the CMP pad 104 may also be damaged when the pad conditioner debris comes between the surfaces of the CMP pad 104 and the semiconductor wafer 108. This can result in a CMP pad 104 that needs to be scrapped or repaired. Either of these occurrences leads to high costs in terms of time, resources, and money in order to fix the damage or scrap the semiconductor wafer 108 or the CMP pad 104. Furthermore, CMP processes may be interrupted for a period of time while repairs are made.

Another potential problem is the crystallization of the slurry during the CMP process. When the slurry is provided onto the surface of the rotating CMP pad 104, the rotation of the CMP pad 104 causes the slurry to flow toward the outer perimeter of the CMP pad 104 and off of the CMP pad 104. Nevertheless, it is possible that some portion of the slurry may not quickly flow off of the CMP pad 104. This portion of the slurry may crystallize. The crystallized portion of the slurry can have a similar effect as the pad conditioner debris. Accordingly, the crystallized portion of the slurry can damage the semiconductor wafer 108 or the CMP pad 104.

The CMP system 100 utilizes the suction system 114 to prevent damage to the semiconductor wafer 108 and the CMP pad 104 from the pad conditioner debris and the slurry. The suction system 114 removes pad conditioner debris and slurry from the rotating CMP pad 104 during the CMP process. The suction system 114 can remove the pad conditioner debris and the slurry via a suction effect.

The suction system 114 can include a suction head that is placed slightly above the CMP pad 104 during the CMP process. The suction head can be positioned downstream from the pad conditioner 112 and upstream from the CMP pad 104. As the pad conditioner 112 sweeps across the rotating CMP pad 104, possibly generating pad conditioner debris, the suction head is positioned such that the pad conditioner debris will encounter the suction head before the pad conditioner debris will encounter the semiconductor wafer 108. The pad conditioner debris is sucked into the suction head of the suction system 114 before the pad conditioner debris can encounter the semiconductor wafer 108. In this way, the suction system 114 protects the semiconductor wafer 108 from the pad conditioner debris.

The suction head of the suction system 114 also removes slurry from the surface of the CMP pad 104. The positioning of the suction system 114 is such that after the slurry encounters the semiconductor wafer 108 and is carried by the rotating CMP pad 104, the suction head sucks up any remaining slurry before the slurry again can encounter the semiconductor wafer 108. Accordingly, the suction system 114 removes slurry before the slurry can crystallize. In the chance that any of the slurry has crystallized, the suction system 114 removes the crystallized slurry before the crystallized slurry can damage the semiconductor wafer 108.

In one embodiment, the suction system is positioned to suck up as much of the slurry as possible in order to recycle the slurry. Accordingly, the suction system 114 can be coupled to the slurry supply system 110. Slurry that is sucked up by the suction system 114 can be passed to the slurry supply system 110. In one example, the recycled slurry is provided to a slurry tank of the slurry supply system 110 such that the recycled slurry will again be provided onto the CMP pad 104 by the slurry supply system 110. Because CMP pads 104 are eventually replaced, it is possible that the recycled slurry will be provided onto a different CMP pad during the subsequent CMP process. This is highly beneficial because slurry material can be very expensive. The suction system 114 can reduce the amount of slurry that needs to be acquired for the CMP system 100 because the CMP system 100 reuses or recycles a large portion of the slurry via the suction system 114.

In one embodiment, the suction system 114 includes a filter 116. The filter 116 is configured to filter out pad conditioner debris from the slurry. Because the suction system 114 removes both slurry and pad conditioner debris from the CMP pad 104, the pad conditioner debris is mixed with the slurry in the suction system 114. The filter 116 is positioned in a flow path of the mixture of slurry and pad conditioner debris. The filter 116 catches the pad conditioner debris and passes the slurry. The filter 116 is upstream from the slurry supply system 110. In this way, the filter 116 ensures that pad conditioner debris will not be provided from the suction system 114 to the slurry supply system 110.

In one embodiment, the filter 116 is a porous material with a filter rating selected to catch particles or material with a size larger than the size indicated by the filter rating and to pass particles or material with a size smaller than the size indicated by the filter rating. Accordingly, the filter rating of the filter 116 is selected to pass the slurry and to catch the pad conditioner debris. The pad conditioner debris includes particles or grains that are larger than the compounds and molecules of the slurry.

In one embodiment, the filter 116 has a filter rating less than or equal to 30 micrometers. In this example, the filter rating is selected because the expected smallest size of the pad conditioner debris particles is greater than 30 μm. The expected small size of the pad conditioner debris can be based on both the surface material of the pad conditioner 112 and the deposition process for depositing the surface material of the pad conditioner 112. For example, if the pad conditioner 112 has a diamond surface including diamond particles formed in a process that has grain sizes greater than or equal to 30 micrometers, then the filter 116 may have a filter rating less than or equal to 30 micrometers.

In one embodiment, the filter 116 has a filter rating less than 100 nm. In one example, the diamond surface of the pad conditioner 112 is formed by a chemical vapor deposition process. The chemical vapor deposition process results in a diamond coating that does not have a large grain sizes. In this case, pad conditioner debris may include particles as small as 100 nm. Accordingly, the filter 114 may have a filter rating less than or equal to 100 nm. Filters 114 having filter ratings smaller than, greater than, or between the exemplary filter ratings described above can be utilized without departing from the scope of the present disclosure.

In one embodiment, the control system 118 controls the various components of the CMP system 100. The control system 118 can include one or more computer memories storing software instructions for controlling the CMP system 100. The control system 118 can include one or more processors configured to execute the software instructions. The control system 118 can be electronically connected via a wired or wireless connections to the various components of the CMP system 100. The control system 118 can activate, deactivate, and adjust the operation of the various components of the CMP system 100. The control system 118 may be dispersed among one or more of the components of the CMP system 100.

In one embodiment, the control system 118 activates the suction system 114 as soon as a CMP process begins. In this case, the suction system 114 is active throughout the CMP process regardless of the age or accumulated usage of the various components of the CMP system 100. The control system 118 deactivates the suctions system 114 when the CMP process ends.

In one embodiment, the control system 118 selectively activates the suction system 114 based on various criteria. For example, the control system 118 may activate the suction system based on the age or accumulated usage of the pad conditioner 112. Before the pad conditioner has been used much, particles from the pad conditioner 112 are less likely to break off. Accordingly, in some cases it may be desirable to refrain from activating the suction system 114 while the pad conditioner is new or only lightly used. After the pad conditioner 114 has aged or has been used more, the control system 118 may activate the suction system 114 due to the increased likelihood that particles, such as diamond particles, may become dislodged from the pad conditioner. The control system 118 may also selectively activate the suction system 114 based on the age or accumulated usage of the CMP pad 104. Selectively activating the suction system 114 can extend the lifetime of the suction system 114. In particular, selectively activating the suction system 114 may extend the lifetime of the filter 114. Additionally, the control system 118 may activate the suction system 114 intermittently during a CMP process. For example, the control system 118 may activate the suction system 114 for every other rotation of the CMP pad 104, for every third rotation of the CMP pad 104, or for other selected intermittent patterns.

Figure 2A:
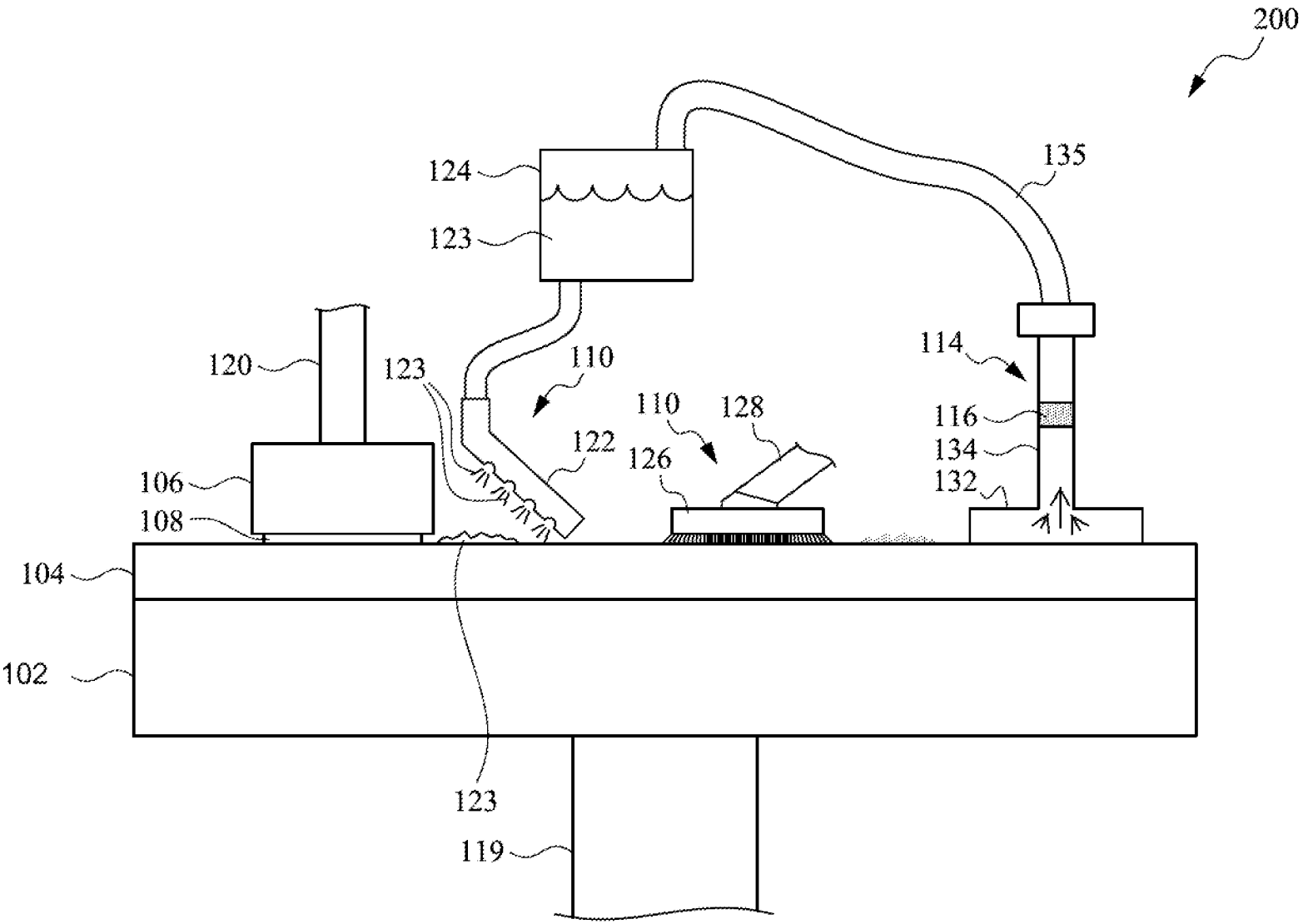
FIG. 2A is a side view of a chemical mechanical planarization system, according to one embodiment.

FIG. 2A is a side view illustration of a CMP system 200, according to one embodiment. The CMP system 200 is configured to perform a CMP process on a semiconductor wafer 108. The CMP system 200 includes a platen 102. A driveshaft 119 is coupled to the platen 102. The driveshaft 119 is configured to rotate the platen 102 during a CMP process. A CMP pad 104 is positioned on a top surface of the platen 104. When the platen 102 rotates, the CMP pad 104 rotates as well.

The CMP system 200 includes a CMP head 106. The CMP head 106 holds a semiconductor wafer 108 such that a surface to be planarized is facing downward. The CMP head 106 is coupled to and suspended by a driveshaft 120. The driveshaft 120 can rotate the CMP head 106 during the CMP process. Furthermore, the driveshaft 120, or a component coupled to the driveshaft 120 can lower the CMP head 106 in order to place the semiconductor wafer 108 in contact with the CMP pad 104 during the CMP process.

The CMP system 200 includes a slurry supply system 110. The slurry supply system 110 includes a slurry supply tube 122 and a slurry tank 124. The slurry tank 124 holds a slurry 123. The slurry 123 can include a solution of water and one or more compounds selected to chemically interact with materials on a surface of the semiconductor wafer 108 to be planarized. During the CMP process, slurry 123 is passed from the slurry tank 124 onto the CMP pad 104 via the slurry supply tube 122.

The CMP system 200 includes a pad conditioner 112. The pad conditioner 112 includes a pad conditioner head 126 coupled to a support arm 128. During a CMP process, the bottom surface of the pad conditioner head 126 is placed in contact with the top surface of the CMP pad 104. The pad conditioner head 126 rotates during the CMP process. The support arm 126 sweeps the pad conditioner head 126 across the top surface of the CMP pad 104 in a selected pattern. The bottom surface of the pad conditioner head 126 includes a material selected to condition the CMP pad 104 as described previously in relation to FIG. 1. Furthermore, as described in relation to FIG. 1, pad conditioner debris 129 may be generated due to the interaction between the CMP pad 104 and the pad conditioner head 126. The pad conditioner debris 129, as well as crystallized slurry, may damage the semiconductor wafer 108 as described in relation to FIG. 1.

The CMP system 200 includes a suction system 114 configured to suck up the pad conditioner debris 129 and the slurry 123 from the CMP pad 104. The suction system 114 includes a suction head 132. The suction head 132 can include an opening that faces the top surface of the CMP pad 104. The suction system 114 can include one or more pumps or motors configured to generate a pressure differential that results in a suction effect that causes the pad conditioner debris 129 and the slurry 123 to be sucked into the suction head 132 via the opening and the suction head 132. The suction system 114 also includes a suction tube 134. The pad conditioner debris 129 and the slurry 123 are passed from the suction head 132 into the suction tube 134.

In one embodiment, the suction system 114 also includes a filter 116. The filter 116 is positioned in the suction tube 134. The filter 116 filters pad conditioner debris 129, and then the other materials sucked up by the suction head 132, from the slurry 123. Accordingly, the slurry 123 passes through the filter 116 while the pad conditioner debris 129 is caught in the filter 116.

The suction system 114 includes a hose 135 coupled between the suction tube 134 and the slurry tank 124. The suction system passes recycled slurry from the suction tube 134 to the slurry tank 124 via the hose 135. As described previously in relation to FIG. 1, the slurry supply system 110 can reuse the slurry 123 recycled by the suction system 114. The slurry supply system 110, the pad conditioner 112, and the suction system 114 can have different structures, components, and arrangements of components than those shown in the Figures without departing from the scope of the present disclosure.

Figure 2B:
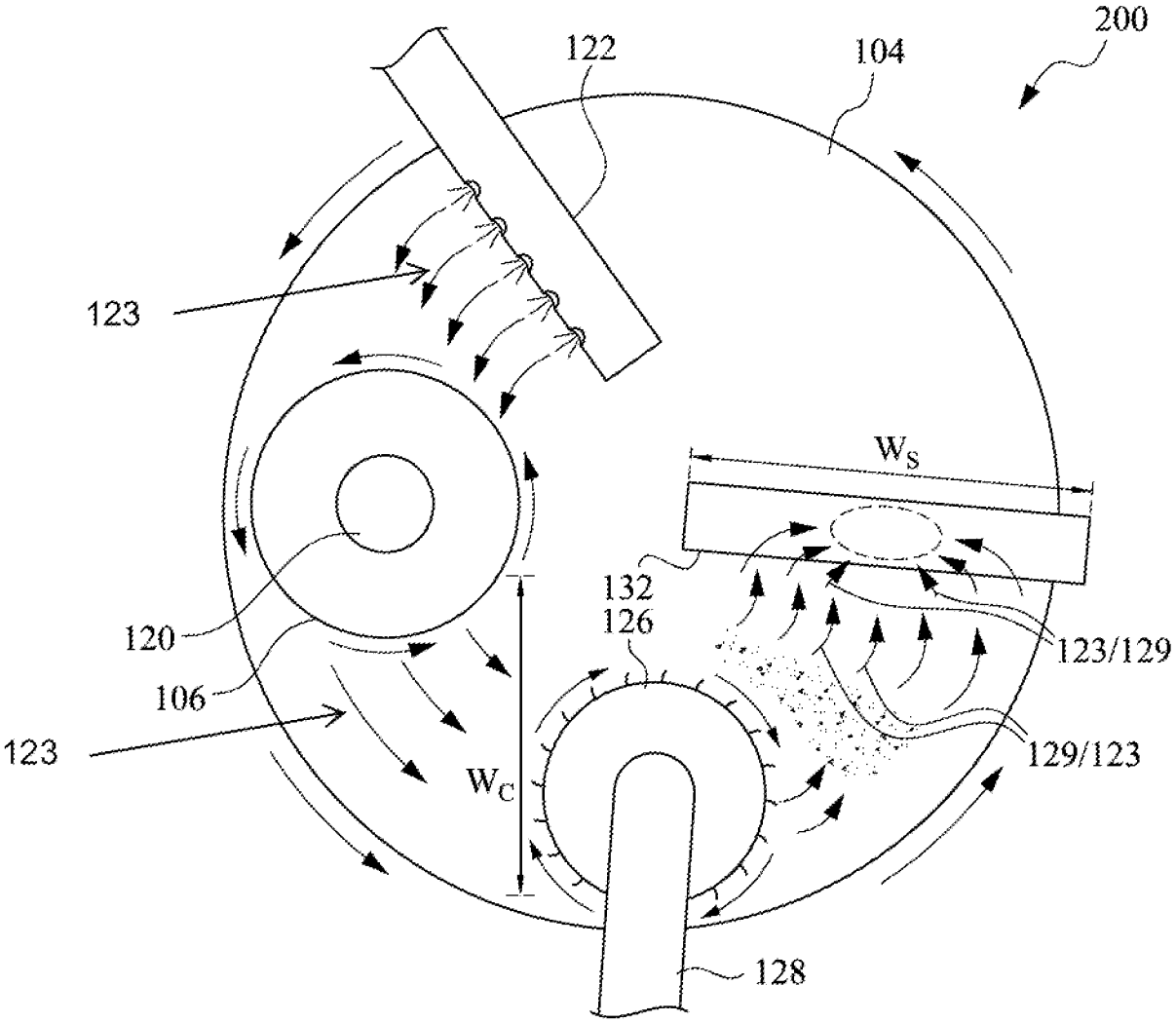
FIG. 2B is a top view of the chemical mechanical planarization system of FIG. 2A, according to one embodiment.

FIG. 2B is a top view of a CMP system 200 of a CMP system, according to one embodiment. The CMP system 200 includes a CMP pad 104, a CMP head 106, a slurry supply system 110, a pad conditioner head 126, and the impurity removal system 104. As described previously, the CMP pad 104 has a circular top surface and is placed on a platen 102 with a circular top surface. Because the platen is below the CMP pad 104, platen is not visible in the top view of FIG. 2A. The platen 102 is configured to rotate during the CMP process. The platen 102 may rotate with a rotational velocity of between 20 RPM and 40 RPM, though other rotational velocities can be utilized without departing from the scope of the present disclosure. In the example of FIG. 2B, the platen 102 and the pad 104 rotate in a counterclockwise direction. The platen 102 can be coupled to the shaft 119 that drives the rotation of the platen. The platen 102 has a diameter between 50 cm to 75 cm, though pads (and corresponding platens) of other sizes can be utilized without departing from the scope of the present disclosure.

In the example FIG. 2B, the slurry supply tube 122 is positioned upstream from the CMP head 106. The slurry supply tube 122 supplies a slurry 123 onto the rotating pad 104 during the CMP process. In particular, the slurry supply tube 122 has a plurality of nozzles or apertures that each output the slurry 123 onto the pad 104. The slurry supply tube 122 can supply the slurry with a total flow rate between 100 mL/minute and 500 mL/minute, though other slurry flow rates can be utilized without departing from the scope of the present disclosure.

As fresh slurry 123 is supplied from the slurry supply tube 122 onto the pad 104, the rotation of the pad 104 carries the fresh slurry 123 into contact with the wafer 140 held by the CMP head 106. The interaction of the slurry 123 with the wafer 140 results in debris and impurities in the slurry 123. The slurry 123 is no longer fresh after encountering the wafer held by the CMP head 106. Slurry that has already encountered the wafer 108 may be referred to as used slurry.

In the example of FIG. 2B, the pad conditioner head 126 is positioned downstream from the CMP head 106. Accordingly, the rotation of the pad 104 carries the slurry from the CMP head 106 to the pad conditioner head 126. In one example, the pad conditioner head 126 travels through a conditioner scanning width $W_C$. $W_C$ is a distance that is less than the radius of the pad 104. The pad conditioner head 126 moves back and forth through the scanning width $W_C$ while rotating. The scanning width $W_C$ has a value between 15 cm and 30 cm, though other values can be used without departing from the scope of the present disclosure.

The action of the pad conditioner can generate particles and debris 129 that mix with the used slurry 123. Rotation of the pad 104 carries some of the used slurry 123 back into contact with the wafer held by the CMP head 106. Accordingly, some of the impurities and debris and the used slurry may come into contact with the wafer held by the CMP head 106. Though not shown in FIG. 2A, the entire surface of the pad 104 upstream from the suction head 132 may be covered in slurry 123 during the CMP process. The slurry 123 generally follows a spiral pattern and is forced to the edge of the pad 104 due to the rotational motion of the pad 104. The slurry supply tube 122 constantly supplies fresh slurry 123 during the CMP process.

As described previously, the contact of the debris 129 and used/crystallized slurry in the used slurry 123 may cause damage to the wafer. Accordingly, the suction head 132 is placed on the pad 104 downstream from the conditioner head 126 and upstream from the slurry supply tube 122. This position enables the suction head 132 to suck up used slurry 123 and debris 129 from the surface of the CMP pad 104 before the used slurry 123 and debris 129 can encounter the wafer 108 held by the CMP head 106.

The suction head 132 has a width $W_S$. The width $W_S$ is selected to ensure that the suction head 132 can suck up all of the used slurry 123 and debris 129 on the pad 104. Typically, the width $W_S$ should be greater than the conditioner head scanning width $W_C$. In one embodiment, the width $W_S$ is equal to or greater than the radius of the CMP pad 104. This ensures that the used slurry 123 and debris 129 will encounter the suction head 132 before encountering the wafer 108. In one example, the width $W_S$ can be between 20 cm and 40 cm, though other values of the width $W_S$ can be used without departing from the scope of the present disclosure. The suction head 132 and the suction system 114 in general can be configured to replenish the slurry tank 124 in real time. The slurry supply system 110 constantly supplies fresh slurry on to the CMP pad 104 during a CMP process. The suction system 114 recycles the slurry into the slurry tank 124 at the same rate that the slurry supply system 110 supplies the slurry 123. In one embodiment, another system may also supply new slurry 123 into the slurry tank 124 during operation. This is because some of the slurry 123 may fall off the edge of the pad 104 due to the rotation of the pad 104. Accordingly, the suction system 114 may not capture all of the used slurry. A separate resupply system can augment the supply of slurry into the slurry tank 124.

Figure 3:
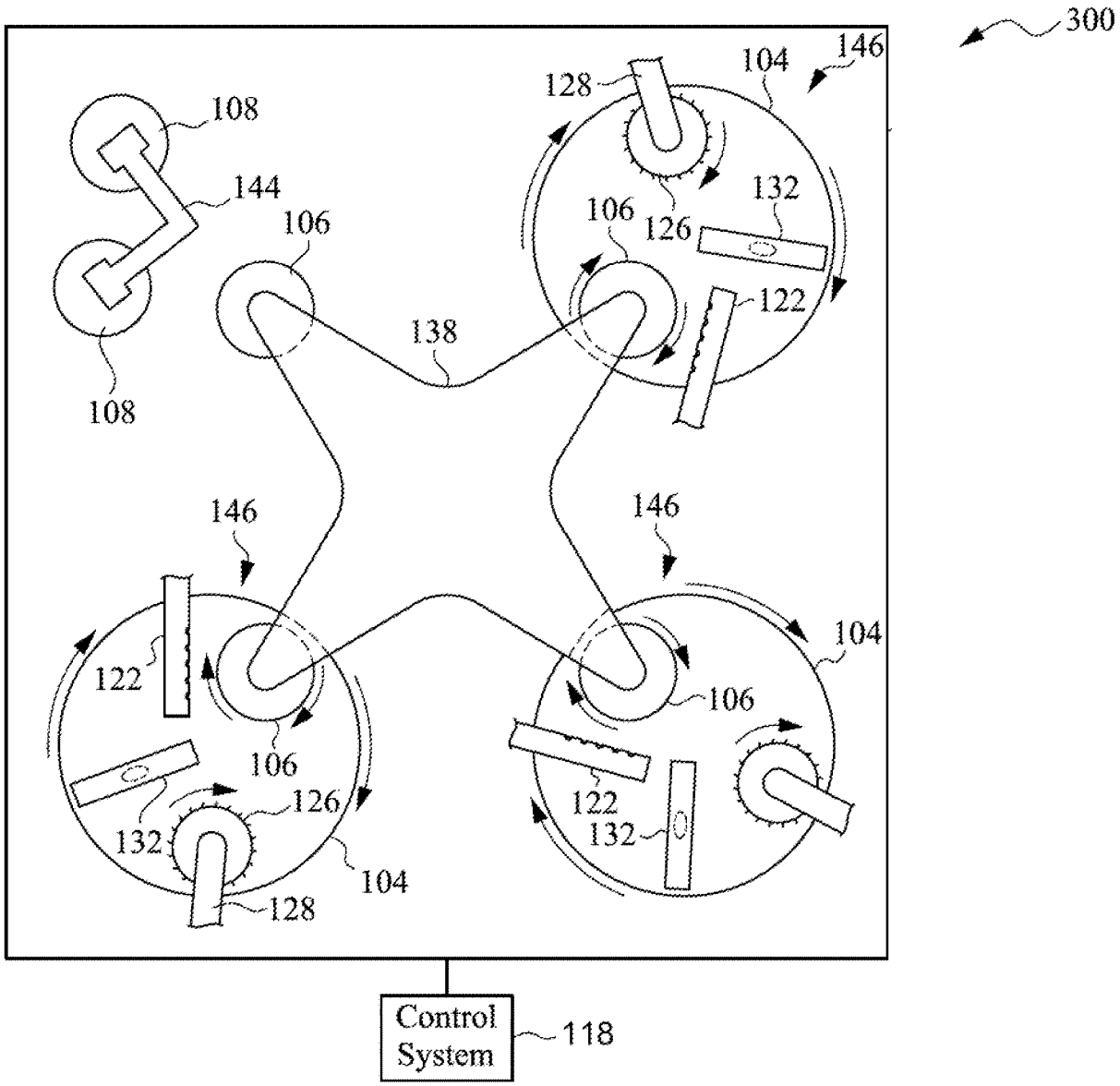
FIG. 3 is top view of a chemical mechanical planarization system, according to one embodiment.

FIG. 3 is a top view of a CMP system 300, according to one embodiment. The CMP system 300 includes a frame 138, a wafer load and unload unit 140, and three planarization stations 146. The CMP system 300 also includes a control system 118. Each of the planarization stations 146 may be substantially similar to the CMP system 300 of FIG. 2B.

In the example of FIG. 3, the frame 138 is coupled to four CMP heads 106. The CMP heads 106 are each connected to the frame 138 by a respective shaft 120 (not visible in the top view of FIG. 3, see FIG. 2). The shaft 120 can enable and drive rotation of the CMP head 106. The shaft 120 can also raise and lower the CMP head 106 relative to the frame 138. Alternatively, the frame 138 itself can be raised and lowered. The frame 138 can rotate in order to move the CMP heads 106 between the wafer load and unload unit 140 and the various planarization stations 146.

In one embodiment, each planarization station 146 includes a CMP pad 104 positioned on a circular platen 102 (not visible in the top view of FIG. 3, see FIG. 2). Each planarization station 146 includes a respective slurry supply system 110 and a respective pad conditioner 112. Each slurry supply system 110 includes a slurry supply tube 124. Each pad conditioner 124 includes pad conditioner head 126 and a support arm 128. Each planarization station 146 includes a suction system 114. Each suction system 114 can include a suction head 132 and a suction tube 134. The CMP heads 106, the conditioner pads 104, slurry supply systems 110, the pad conditioners 112, and the suction systems 114 can function substantially as described in relation to FIGS. 1 and 2.

The three planarization stations 146 facilitate simultaneous processing of multiple semiconductor wafers 108 in a short time. During operation of the CMP system 300, the platens 102 (see FIG. 2) rotate, thereby rotating the CMP pads 104. During operation, the slurry supply tubes 122 are positioned over the CMP pads 104. The slurry supply tubes 122 supply a slurry 123 onto the CMP pads 104. During operation, the pad conditioner heads 126 are swept over the respective polishing CMP pads 104 for conditioning of the CMP pads 104. During operation, the suction systems 114 remove pad conditioner debris 129 (see FIG. 2) and slurry 123 (see FIG. 2) from the CMP pad 104.

In the example of FIG. 3, the CMP pads 104 rotate in a clockwise direction. The clockwise rotation of the CMP pads 104 causes the slurry 123 to be carried to the CMP heads 106. The clockwise rotation of the CMP pads 104 causes the pad conditioner debris 129 to be carried to the suction heads 132. The suction heads 132 remove the pad conditioner debris 129 before the pad conditioner debris 129 can be carried to the CMP heads 106. Likewise, slurry 123 that has already encountered the CMP heads 106 will encounter and be removed by the suction heads 132 before again encountering the CMP heads 132.

In one embodiment, a robot arm 144 delivers a semiconductor wafer 108 to the wafer load and unload unit 140. A CMP head 106 is lowered onto the wafer load and unload unit 140 in order to retrieve the wafer from the wafer load and unload unit 140. As described previously in relation to FIG. 1, the CMP head 106 can hold the semiconductor wafer 108 via a combination of pressure and a lateral retaining ring.

After the CMP head 106 retrieves a semiconductor wafer from the wafer load and unload unit 140, the frame 138 rotates clockwise to position the CMP head 106 over a first planarization station 146. The CMP head 106 presses the exposed surface of the semiconductor water 108 downward onto the rotating CMP pad 104. The CMP head 106 may itself rotate the semiconductor wafer 108. The pad conditioner 112 conditions the CMP pad 104. The slurry supply system 110 supplies slurry onto the rotating CMP pad 104. The suction system 114 removes pad conditioner debris and slurry. After this process is complete, the frame 138 again rotates counterclockwise to position the CMP head 106 over the next planarization station 146 and the planarization process is repeated. The frame 138 again rotates clockwise to position the CMP head 106 over the next planarization station 146 and the planarization process is repeated.

After the CMP head 106 has carried the semiconductor water 108 to each planarization station 146, the frame 138 is rotated clockwise again to position the CMP head 106 over the wafer load and unload unit 140. The CMP head 106 delivers the planarized semiconductor wafer 108 to the wafer load and unload unit 140. The robot arm 144 retrieves the planarized semiconductor wafer 108 from the water load and unload unit 140.

FIG. 3 illustrates one example of a CMP system 300. A CMP system 300 can include different components, different arrangements of components, and different functions without departing from the scope of the present disclosure. For example, in some embodiments, the suction system 114 may be differently positioned relative to the pad conditioner 112 and the slurry supply system 110. The suction system 114 may be positioned downstream from the CMP head 106 and upstream from the pad conditioner 112. Various placements of the suction system can be utilized without departing from the scope of the present disclosure.

In one embodiment, the CMP system 300 performs a CMP process after deposition of a metal for a gate electrode of a transistor. For example, tungsten may be deposited in a trench formed for a gate electrode of a transistor, After deposition of the gate electrode tungsten, the wafer may be transferred to the CMP system 300. The CMP system 300 may then perform a CMP process remove excess tungsten and planarize the surface of the gate electrode. The CMP system 300 may be used to perform planarization operations after a large variety of semiconductor processes. Such semiconductor processes can include metal deposition for metal plugs, metal deposition for metal lines, silicon oxide deposition for trench isolation or for other purposes, and for other semiconductor processes.

Figure 4:
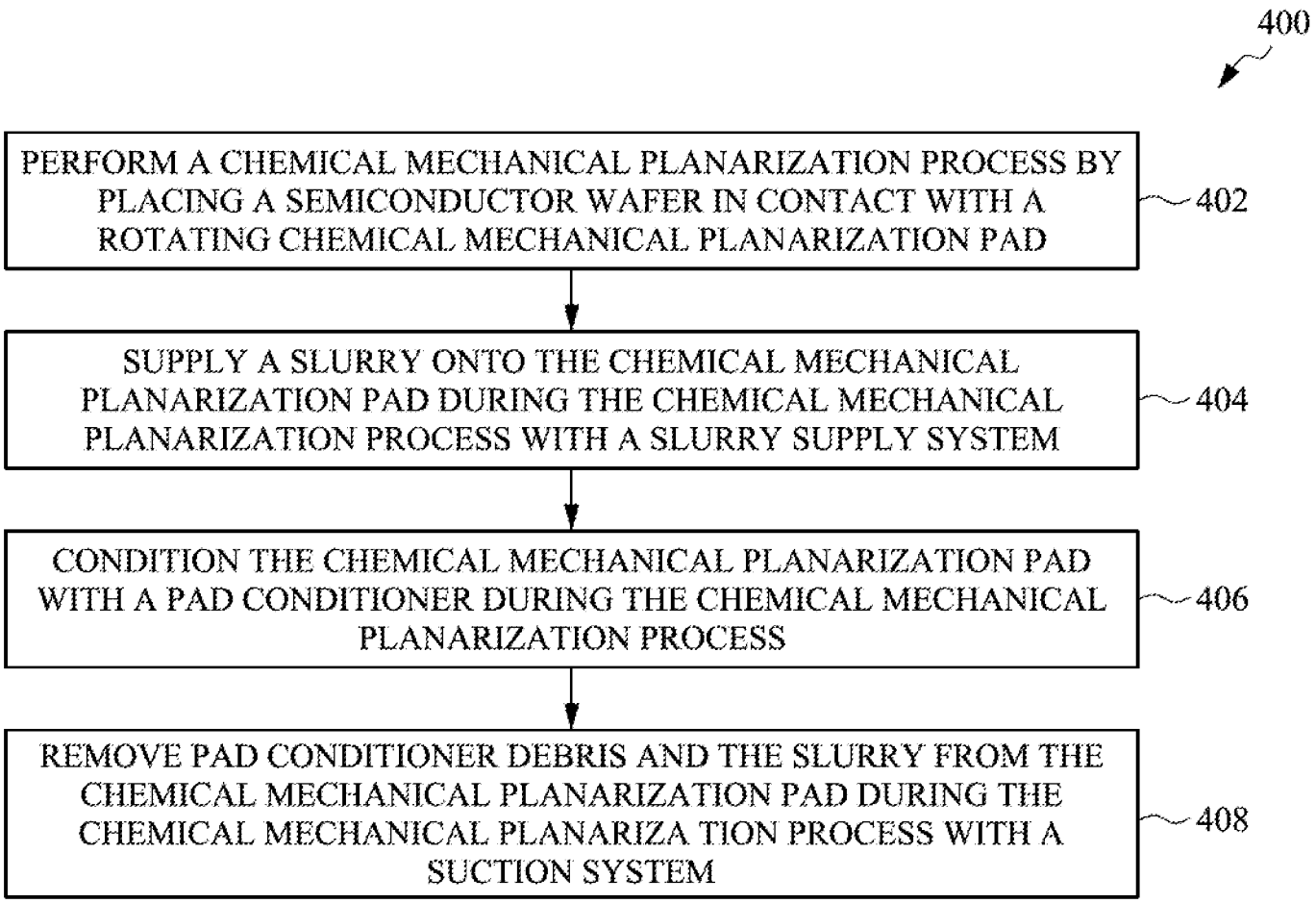
FIG. 4 is a flow diagram of a method for operating a chemical mechanical planarization system, according to one embodiment.

FIG. 4 is a flow diagram of a method 400 for operating a chemical mechanical planarization system, according to one embodiment. At 402, the method 400 includes performing a chemical mechanical planarization process by placing a semiconductor wafer in contact with a rotating chemical mechanical planarization pad. One example of a semiconductor wafer is the semiconductor wafer 108 of FIG. 1. One example of a CMP pad is the CMP pad 104 of FIG. 1. At 404, the method 400 includes conditioning the chemical mechanical planarization pad with a pad conditioner during the chemical mechanical planarization process. One example of a pad conditioner is the pad conditioner 112 of FIG. 1. At 406, the method 400 includes supplying a slurry onto the chemical mechanical planarization pad during the chemical mechanical planarization process with a slurry supply system. One example of a slurry supply system is the slurry supply system 110 of FIG. 1. At 408, the method 400 includes removing pad conditioner debris and the slurry from the chemical mechanical planarization pad during the chemical mechanical planarization process with a suction system. One example of a suction system is the suction system 114.

Figure 5:
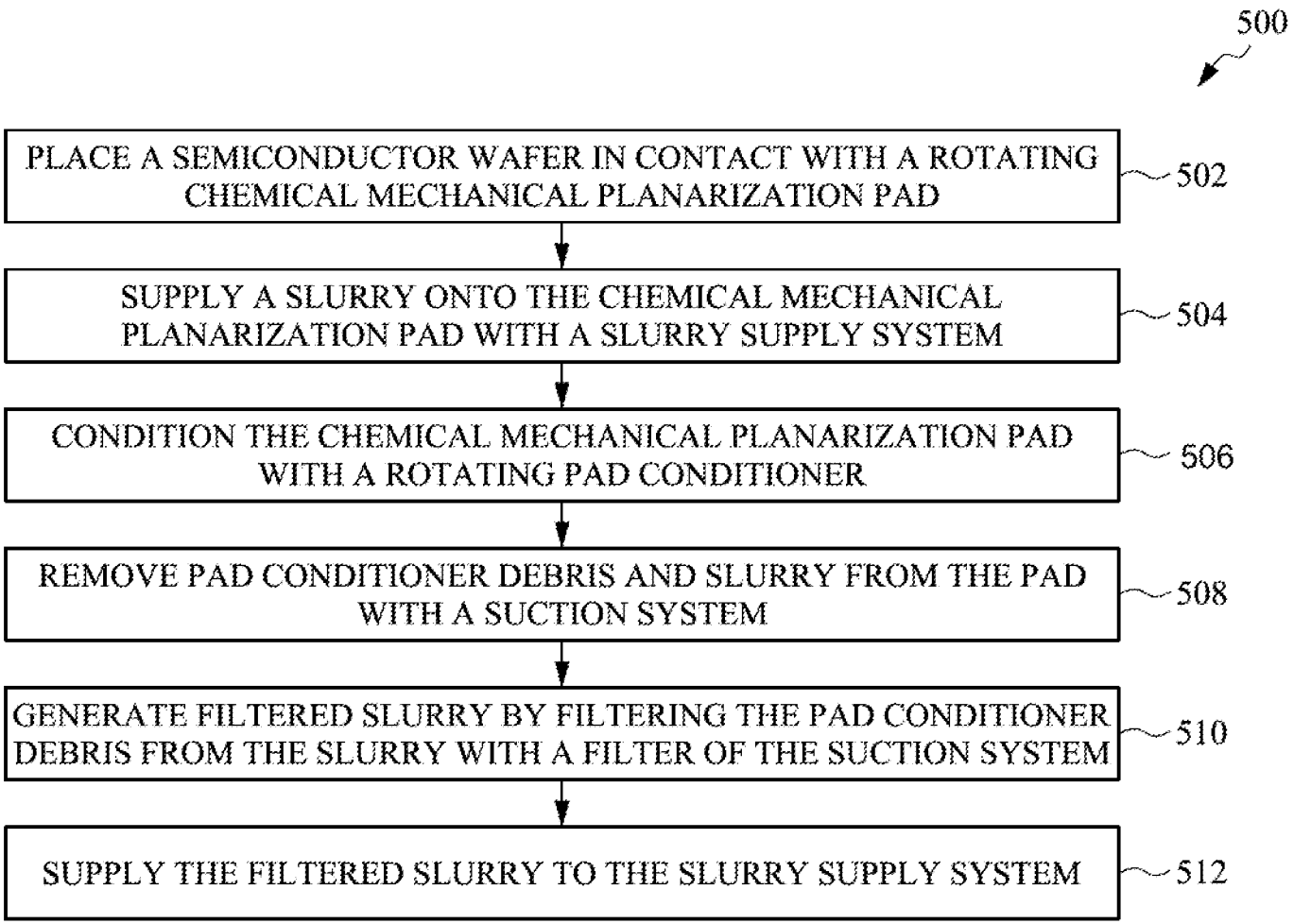
FIG. 5 is a flow diagram of a method for operating a chemical mechanical planarization system, according to one embodiment.

FIG. 5 is a flow diagram of a method 500 for operating a CMP system, according to one embodiment. At 502, the method 500 includes placing a semiconductor wafer in contact with a rotating chemical mechanical planarization pad. One example of a semiconductor wafer is the semiconductor wafer 108 of FIG. 1. One example of a CMP pad is the CMP pad 104 of FIG. 1. At 504, the method 500 includes supplying a slurry onto the chemical mechanical planarization pad with a slurry supply system. One example of a slurry supply system is the slurry supply system 110 of FIG. 1. At 506, the method 500 includes conditioning the chemical mechanical planarization pad with a rotating pad conditioner. One example of a pad conditioner is the pad conditioner 112 of FIG. 1. At 508, the method 500 removing pad conditioner debris and slurry from the pad with a suction system. One example of a suction system is the suction system 114 of FIG. 1. At 510, the method 500 includes generating filtered slurry by filtering the pad conditioner debris from the slurry with a filter of the suction system. One example of a filter is the filter 116 of FIG. 1. At 512, the method 500 includes supplying the filtered slurry to the slurry supply system.

In one embodiment, a method includes performing a CMP process by placing a semiconductor wafer in contact with a rotating CMP pad and conditioning the CMP pad with a pad conditioner during the CMP process. The method incudes supplying a slurry onto the CMP pad during the CMP process with a slurry supply system and removing pad conditioner debris and the slurry from the CMP pad during the CMP process with a suction device.

In one embodiment, a system includes a platen configured to hold a CMP pad and to rotate the CMP pad. The system includes a chemical mechanical planarization head configured to hold a semiconductor wafer and to place the semiconductor wafer in contact with the CMP pad while the CMP pad is rotating. The system includes a slurry supply system configured to supply a slurry onto the CMP pad while the semiconductor wafer is in contact with the CMP pad and a suction system configured to remove pad conditioner debris and slurry from the CMP pad while the semiconductor wafer is in contact with the CMP pad.

In one embodiment, a method includes placing a semiconductor wafer in contact with a rotating CMP pad and supplying a slurry onto the CMP pad with a slurry supply system. The method includes conditioning the CMP pad with a rotating pad conditioner and removing pad conditioner debris and slurry from the pad with a suction system. The method includes generating filtered slurry by filtering the pad conditioner debris from the slurry with a filter of the suction system and supplying the filtered slurry to the slurry supply system.

Embodiments of the present disclosure provide many benefits over traditional chemical mechanical planarization systems. Embodiments of the present disclosure utilize a suction system to prevent damage to semiconductor wafers and chemical mechanical planarization equipment. Accordingly, embodiments of the present disclosure increase semiconductor wafer yields and reduce the need for technicians or experts repair or replace damaged equipment. Instead, the suction system removes dangerous debris from the chemical mechanical planarization pad before the debris can damage the pad or the semiconductor wafer. The result is that time and resources are not wasted replacing equipment and scrapped semiconductor wafers.

The various embodiments described above can be combined to provide further embodiments. Aspects of the embodiments can be modified, if necessary, to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system, comprising:

a platen configured to hold a wafer on a chemical mechanical planarization pad during a chemical mechanical planarization process;

a slurry supply system configured to supply a slurry onto the chemical mechanical planarization pad during the chemical mechanical planarization process;

a pad conditioner configured to perform a conditioning process to condition the chemical mechanical planarization pad during the chemical mechanical planarization process;

a suction system configured to remove pad conditioner debris and the slurry from the chemical mechanical planarization pad during the chemical mechanical planarization process; and a control system configured to, in operation, selectively activate and deactivate the suction system during the conditioning process with an intermittent pattern to remove the pad conditioner debris and the slurry from the chemical mechanical planarization pad, the intermittent pattern includes activating and deactivating the suction system every two or more rotations of the chemical mechanical planarization pad.

2. The system of claim 1, wherein the suction system includes a filter configured to filter the pad conditioner debris from the slurry after removing the pad conditioner debris and the slurry from the chemical mechanical planarization pad.

3. The system of claim 2, wherein the suction system is configured to recycle and resupply the slurry removed from the pad to the slurry supply system.

4. The system of claim 2, wherein the filter has a filter rating less than or equal to 30 um.

5. The system of claim 4, wherein the filter rating is less than or equal to 100 nm.

6. The system of claim 4, wherein the suction system includes a suction head configured to remove the pad conditioner debris while positioned above or in contact with the chemical mechanical planarization pad.

7. The system of claim 6, wherein the suction system includes a suction tube configured to pass the pad conditioner debris and the slurry from the suction head to the filter.

8. The system of claim 1, wherein the pad conditioner conditions the chemical mechanical planarization pad by rotating while in contact with the chemical mechanical planarization pad.

9. A system, comprising:

a platen configured to hold a chemical mechanical planarization pad and to rotate the chemical mechanical planarization pad;

a chemical mechanical planarization head configured to hold a semiconductor wafer and to place the semiconductor wafer in contact with the chemical mechanical planarization pad while the chemical mechanical planarization pad is rotating;

a slurry supply system configured to supply a slurry onto the chemical mechanical planarization pad while the semiconductor wafer is in contact with the chemical mechanical planarization pad; and a suction system configured to remove pad conditioner debris and slurry from the chemical mechanical planarization pad while the semiconductor wafer is in contact with the chemical mechanical planarization pad, the suction system includes:

a suction head configured to be placed on or above the chemical mechanical planarization pad during rotation; and a suction tube configured to pass the pad condition debris and the slurry to a filter that is present within the suction tube; and a control system configured to, in operation, selectively activate and deactivate the suction system during a conditioning process with an intermittent pattern to remove the pad conditioner debris and the slurry from the chemical mechanical planarization pad, wherein the intermittent pattern includes activating and deactivating the suction system every two or more rotations of the chemical mechanical planarization pad.

10. The system of claim 9, wherein the suction system includes a filter configured to filter the pad conditioner debris from the slurry.

11. The system of claim 10, wherein the suction system is configured to provide the filtered slurry back to the slurry supply system.

12. The system of claim 11, wherein the slurry supply system is configured to resupply the slurry from the suction system to the chemical mechanical planarization pad.

13. The system of claim 11, wherein the suction system includes: a hose that is coupled to the suction tube; and a slurry tank coupled to the hose and coupled to the slurry supply system, the slurry tank is configured to receive the filter slurry passed through the filter in the suction tube.

14. The system of claim 12, wherein the pad conditioner includes a conditioner head having a diamond material and is configured to condition the chemical mechanical planarization pad by placing the diamond material on the chemical mechanical planarization pad while the chemical mechanical planarization pad is rotating.

15. The system of claim 14, wherein the pad conditioner debris includes diamond material removed from the conditioner head.

16. The system of claim 9, wherein the slurry includes water and one or more chemical compounds selected to chemically react with surface features of the semiconductor wafer.

17. A system, comprising:

a platen configured to hold and rotate a chemical mechanical planarization pad during chemical mechanical planarization process of a semiconductor wafer;

a slurry supply system configured to supply a slurry onto the chemical mechanical planarization pad during the chemical mechanical planarization process;

a rotating pad conditioner configured to perform a conditioning process to condition the chemical mechanical planarization pad during the conditioning of the chemical mechanical planarization process;

a suction system configured to remove pad conditioner debris and the slurry from the pad during the chemical mechanical planarization, to generate filtered slurry by filtering the pad conditioner debris from the slurry with a filter of the suction system, and to supply the filtered slurry to the slurry supply system; and a control system configured to, in operation, selectively activate and deactivate the suction system during the conditioning process with an intermittent pattern to remove the pad conditioner debris and the slurry from the chemical mechanical planarization pad, wherein the intermittent pattern includes activating and deactivating the suction system every two or more rotations of the chemical mechanical planarization pad.

18. The system of claim 17, wherein the slurry supply system is configured to supply the filtered slurry to the chemical mechanical planarization pad during the chemical mechanical planarization process.

19. The system of claim 17, wherein the slurry supply system is configured to supply the filtered slurry to a second chemical mechanical planarization pad.

* * * * *